US009564713B1

(12) United States Patent
Lo

(10) Patent No.: US 9,564,713 B1
(45) Date of Patent: Feb. 7, 2017

(54) DETACHABLE AND LOCKABLE SOCKET

(71) Applicant: Szu Chi Lo, Nantou (TW)

(72) Inventor: Szu Chi Lo, Nantou (TW)

( * ) Notice: Subject to any disclaimer, the term of this patent is extended or adjusted under 35 U.S.C. 154(b) by 0 days.

(21) Appl. No.: 15/139,645

(22) Filed: Apr. 27, 2016

(51) Int. Cl.
*H01R 13/639* (2006.01)
*H01R 13/66* (2006.01)
*H01R 24/60* (2011.01)
*H01R 27/02* (2006.01)

(52) U.S. Cl.
CPC ..... *H01R 13/6395* (2013.01); *H01R 13/665* (2013.01); *H01R 24/60* (2013.01); *H01R 27/02* (2013.01)

(58) Field of Classification Search
CPC ..... H01R 13/6395
See application file for complete search history.

(56) References Cited

U.S. PATENT DOCUMENTS

2012/0104849 A1* 5/2012 Jackson ..... H01R 25/006 307/31

* cited by examiner

*Primary Examiner* — James Harvey
(74) *Attorney, Agent, or Firm* — Muncy, Geissler, Olds & Lowe, P.C.

(57) ABSTRACT

A detachable and lockable socket includes a casing. The casing is provided with a controller, a socket unit, and a pin. The pin is connected with a silicone steel sheet. An outer periphery of the silicone steel sheet is provided with a coil. The controller is able to control the coil to be electrified or not. When the coil is electrified, the coil generates a magnetic field, enabling the pin to have a magnetic attraction force. The pin is attracted and locked to a conducting plate of a power source, avoiding looseness, disengagement and stealing.

3 Claims, 1 Drawing Sheet

DETACHABLE AND LOCKABLE SOCKET

BACKGROUND OF THE INVENTION

1. Field of the Invention

The present invention relates to a detachable and lockable socket, and more particularly to a detachable socket able to generate a magnetic attraction force to be locked, avoiding looseness, disengagement and stealing.

2. Description of the Prior Art

A conventional detachable socket generally comprises a casing. The casing is provided with a pin and an insertion hole. The insertion hole is provided with a conducting plate connected with the pin. The pin is plugged into a wall-mounted socket to connect with a power source. The insertion hole is adapted for insertion of an electric appliance plug to supply power. The conventional detachable socket has the following shortcomings. First, when the pin is plugged into the power socket, it is clamped without any other force to assist in locking. Therefore, the pin may be loose or disengage from the power socket. When the pin disengages from the power socket, the power supply is cut off. When the pin is loose, the power supply is unstable. This may cause a fire accident. Secondly, because the detachable socket doesn't have a locking mechanism, it may be stolen easily.

SUMMARY OF THE INVENTION

The primary object of the present invention is to overcome the shortcomings of the prior art and provide a detachable and lockable socket. The detachable and lockable socket comprises a casing. The casing is provided with a pin. The pin is connected with a silicone steel sheet. The silicone steel sheet is provided with a coil. When the coil is electrified, the coil generates a magnetic field, enabling the pin to have a magnetic attraction force. The pin is attracted and locked to a conducting plate of a power source to provide a locking effect, avoiding looseness and disengagement. The casing is provided with a controller for controlling the coil to be electrified or not.

DETAILED DESCRIPTION OF THE PREFERRED EMBODIMENTS

Embodiments of the present invention will now be described, by way of example only, with reference to the accompanying drawings.

Figure 1:
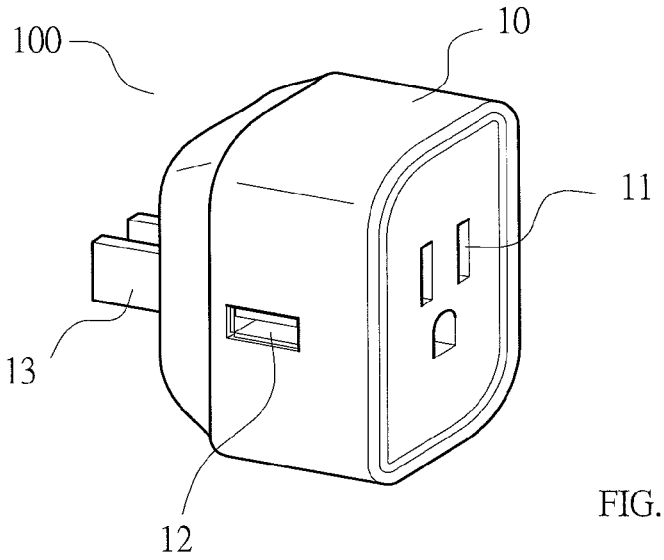
FIG. 1 is a perspective view in accordance with a preferred embodiment of the present invention.
Figure 2:
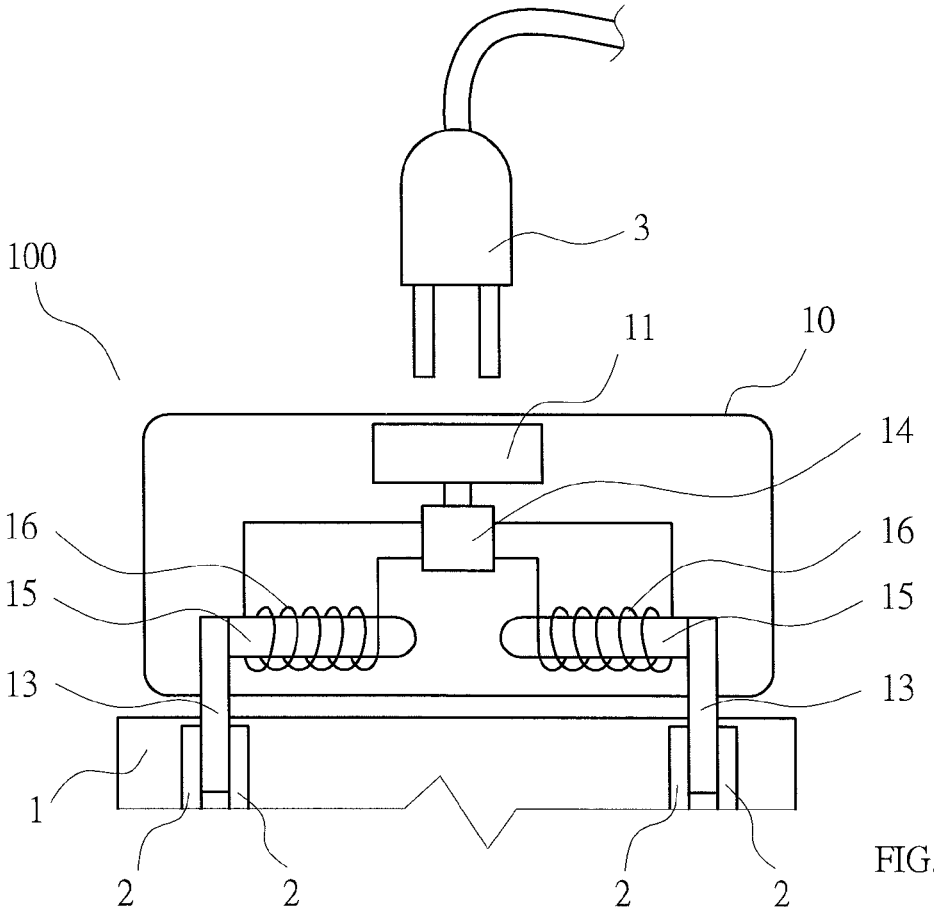
FIG. 2 is a schematic view in accordance with the preferred embodiment of the present invention.

As shown in FIG. 1 and FIG. 2, a detachable and lockable socket 100 according to a preferred embodiment of the present invention comprises a casing 10. The casing 10 is provided with a controller 14, a socket unit 11, a pin 13, and a USB socket 12. The socket unit 11 is adapted for insertion of an electric appliance plug 3 to supply power. The USB socket 12 is adapted for insertion of a telecommunication plug to supply power. The pin 13 is exposed out of the casing 10 and plugged into a conducting plate 2 of a power socket 1 to connect with a power source. The pin 13 is connected with a silicone steel sheet 15. An outer periphery of the silicone steel sheet 15 is provided with a coil 16. The controller 14 can control the coil 16 to be electrified or not. The way for the controller 14 to control connection and disconnection of electricity is that a manual switch, a wireless signal receiver and a remote control are provided. The silicone steel sheet 15 is made of a section of an iron material.

In accordance with the aforesaid structure and device, the function and effect of the present invention are descried in detail as follows. The pin 13 of the socket 100 is plugged into the conducting plate 2 of the power socket 1. The controller 14 is operated to electrify the coil 16 to generate a magnetic field, enabling the pin 13 to have a magnetic attraction force. Thus, the pin 13 is attracted and locked to the conducting plate 2 to provide a locking effect, avoiding looseness, disengagement and stealing. Besides, the present invention also provides a better positioning effect to enhance the stability for supplying power. There is no spark to cause an electrical short circuit fire accident. When the user wants to detach the socket 100 from the power socket 1, the controller 14 is operated for a power failure of the coil 16 to release the attraction force, such that the socket 100 can be pulled out easily.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A detachable and lockable socket, comprising a casing, the casing being provided with a controller, a socket unit, and a pin, the socket unit being adapted for insertion of an electric appliance plug to supply power, the pin being exposed out of the casing and plugged into a conducting plate of a power socket to connect with a power source, the pin being connected with a silicone steel sheet, an outer periphery of the silicone steel sheet being provided with a coil, the controller controlling the coil to be electrified or not, wherein when the coil is electrified, the coil generates a magnetic field, enabling the pin to have a magnetic attraction force, and the pin is attracted and locked to the conducting plate, avoiding looseness and disengagement.

2. The detachable and lockable socket as claimed in claim 1, wherein the casing is provided with a USB socket for insertion of a telecommunication plug to supply power.

3. The detachable and lockable socket as claimed in claim 1, wherein the controller can receive a wireless telecommunication for remotely controlling the coil to be electrified or not.

* * * * *